US005451729A

United States Patent [19]

Onderka et al.

[11] Patent Number: 5,451,729

[45] Date of Patent: Sep. 19, 1995

[54] SINGLE OR MULTIPOLE CIRCUIT BREAKER

[75] Inventors: Oswald Onderka; Fritz Krasser, both of Altdorf, Germany

[73] Assignee: Ellenberger & Poensgen GmbH, Altdorf, Germany

[21] Appl. No.: 214,151

[22] Filed: Mar. 17, 1994

[30] Foreign Application Priority Data

Mar. 17, 1993 [DE] Germany ..... 9303918 U

[51] Int. Cl.[6] ..... H01H 3/00; H01H 9/02

[52] U.S. Cl. ..... 200/18; 200/50 C; 200/307; 200/339

[58] Field of Search ..... 200/5 R–5 EB, 200/6 R–6 C, 17 R, 18, 50 C, 293–307, 339

[56] References Cited

U.S. PATENT DOCUMENTS

| | | | |
|---|---|---|---|
| 3,256,407 | 6/1966 | Klein | 335/173 |
| 3,340,374 | 9/1967 | Shiraishi et al. | 337/126 |
| 3,383,486 | 5/1968 | Powell | 200/250 |
| 3,431,517 | 3/1969 | Ellenberger | 335/35 |
| 4,167,720 | 9/1979 | Krasser | 337/60 |
| 4,727,226 | 2/1988 | Comtois et al. | 200/50 C |
| 4,931,762 | 6/1990 | Fierro | 337/66 |
| 4,937,548 | 6/1990 | Sdunek | 337/70 |
| 5,079,530 | 1/1992 | Tsuchiyama | 335/17 |

FOREIGN PATENT DOCUMENTS

| | | | |
|---|---|---|---|
| 0275517 | 7/1988 | European Pat. Off. | H01H 77/04 |
| 3220960 | 7/1988 | European Pat. Off. | H01H 23/02 |
| 2754195 | 9/1988 | European Pat. Off. | H01H 23/10 |
| 3835073 | 4/1989 | European Pat. Off. | H01H 23/20 |
| 3802765 | 8/1989 | European Pat. Off. | H01H 23/20 |
| 0208613 | 10/1989 | European Pat. Off. | H01H 71/08 |
| 3918567 | 12/1990 | European Pat. Off. | H01H 9/18 |
| 224150 | 6/1985 | German Dem. Rep. | H01H 73/20 |
| 753881 | 8/1952 | Germany . | |
| 1101575 | 3/1961 | Germany | H01H 9/18 |
| 1513242 | 8/1970 | Germany . | |
| 1808524 | 9/1970 | Germany | H01H 73/24 |
| 1513472 | 5/1971 | Germany . | |
| 1463202 | 1/1972 | Germany | H01H 73/56 |
| 326752 | 12/1975 | Germany | H01H 71/10 |
| 2535109 | 7/1976 | Germany | H01H 73/20 |
| 2721162 | 11/1978 | Germany | H01H 71/12 |
| 2928277 | 1/1981 | Germany | H01H 73/32 |
| 8111050 | 8/1981 | Germany | H01H 23/00 |
| 3505004 | 9/1985 | Germany | H01H 73/20 |
| 3935280 | 5/1991 | Germany | H01H 13/52 |
| 9104076 | 8/1991 | Germany | H01H 71/74 |
| 647094 | 12/1984 | Switzerland | H01H 73/24 |
| 2011722 | 7/1979 | United Kingdom | H01H 9/10 |

OTHER PUBLICATIONS

E-T-A prospectus, "Program Overview: Thermal--Magnetic Circuit Breakers", Mar. 9, 1980.

E-T-A prospectus, "Switching, Protective and Control Devices, Overcurrent Circuit Brakers, Thermal, 1- and 3- Pole".

*Primary Examiner*—J. R. Scott

*Attorney, Agent, or Firm*—Spencer, Frank & Schneider

[57] ABSTRACT

A single- or multi-pole circuit breaker has a housing that includes a housing shell and a closure shell attached thereto to form a hollow chamber. The closure shell and the housing shell each having an inside wall surface extending parallel to a shell plane. The circuit breaker includes n−1, where n is an integer greater than 1, intermediate housing shells inserted between the housing shell and the closure shell, and having first and second wall surfaces corresponding to the housing shell wall surface and the closure shell wall surface, respectively. The first wall surface faces the closure shell wall surface, and the second wall surface faces the housing shell wall surface to form n hollow pole chambers. A switching mechanism for tripping the circuit breaker includes a switch lever located within each pole chamber. The switch lever has at least one of a trip lever and a latching lever. Each switch lever is attached to a respective wall surface and is axially seated to pivot in a plane of movement extending approximately parallel to the shell plane. At least one one-piece coupling rod penetrating each switch lever and each intermediate housing shell in a direction perpendicular to the shell plane is provided for coupling each switch lever together for common triggering of all poles.

29 Claims, 5 Drawing Sheets

SINGLE OR MULTIPOLE CIRCUIT BREAKER

CROSS REFERENCE RELATED APPLICATIONS

This application claims the priority of German application Serial No. G 93 03 918.2 filed March 17, 1993, which is incorporated herein by reference.

BACKGROUND OF THE INVENTION

The invention relates to a circuit breaker having a housing. The housing includes a housing shell and a closure shell attached thereto to form a hollow chamber therebetween. The closure shell and the housing shell each have an inside wall surface extending parallel to a shell plane. Also provided are n−1, where n is an integer greater than 1, intermediate housing shells inserted between the housing shell and the closure shell and having first and second wall surfaces corresponding to the housing shell wall surface and the closure shell wall surface, respectively. The first wall surface faces the closure shell wall surface and the second wall surface faces the housing shell wall surface to form n hollow pole chambers. A switching mechanism for tripping the circuit breaker is provided. The switching mechanism includes a switch lever located within each pole chamber comprising at least one of a trip lever and a latching lever. Each switch lever is attached to a respective wall surface and is axially seated to pivot in a plane of movement extending approximately parallel to the shell plane. Each switch lever is coupled together for common triggering of all poles.

A circuit breaker of this type shown in European Patent Disclosure EP-B-0,208,613. The circuit breaker housing disclosed therein includes two outer shells, namely a housing shell and a closure shell that can be attached thereto. The switching mechanism is disposed between the two shells. Trip-free release of the circuit breaker is possible when overcurrent occurs, for example, by means of a bimetallic strip connected to the switching mechanism.

If needed, the single-pole circuit breaker with a pole chamber that is formed between the housing shell and the closure shell can be expanded to a multipole circuit breaker that has a corresponding number of pole chambers. For this purpose, one or a plurality of structurally identical intermediate housing shells are inserted between the housing shell and the closure shell. The partial region of the intermediate housing shell facing the housing shell corresponds structurally to the closure shell. The intermediate housing shell is therefore attached to the housing shell in the same manner as the closure shell. The partial region of the intermediate housing shell facing the closure shell corresponds structurally to the housing shell. In this way the single-pole circuit breaker can be expanded to a circuit breaker having an arbitrary number of poles.

The same switching mechanism is located in each pole chamber. To permit a common triggering of all poles of the circuit breaker, the identical switch levers of all of the pole chambers that cause the opening and closing of the electrical contacts are coupled with one another. The coupling parts are cylindrical pins integral to the switch levers and having a longitudinal axis that extends perpendicularly to the shell plane. A pin is seated on the shells in each pole chamber in the manner of a shaft. To transmit the torque of the triggering switch lever onto the identical switch levers of the other pole chambers, directly adjacent pins engage each other with their pin ends facing one another.

Coupling the switch levers by way of shafts of this type is, however, very disadvantageous. The pins of n pole chambers cooperate as an n-piece shaft. During the rotation of this shaft, friction losses occur between the engaging pins. Further friction losses occur in the bearing bores on the side of the shell for seating the individual pins. Overall, great frictional torques result that continuously reduce the torque of the triggering switch lever to be transmitted in the horizontal assembly direction of the shaft. As the specific number of poles increases, the remaining torque to be transmitted becomes so small that the switch levers disposed at a distance from the directly triggering switch levers no longer trip.

Moreover, the mechanical stability of each pin is reduced by its own torsion moments. The torsion moments additionally reduce the torque to be transmitted. Furthermore, it is expensive to construct the shells of the circuit breaker to permit a problem-free rotational movement of the pins. In this case the diameter of the bearing bore, that is, the amount of bearing play, must be taken into account. Because of production-related influences, however, the desired seating is not always assured, thus creating a danger of a skewed position of the pin with respect to its bearing bore. This effect intensifies to correspond to the number of poles of the circuit breaker. In extreme cases skewed pins can even damage the shells. Warming inside the pole chambers results in deformation of the bearing bores, further impairing the seating of the pins.

SUMMARY OF THE INVENTION

It is an object of the present invention to avoid the aforementioned drawbacks by the provision of at least one one-piece coupling rod penetrating each switch lever and each intermediate housing shell in a direction perpendicular to a shell plane for coupling each switch lever together for common triggering of all poles.

In accordance with the invention, each switch lever is seated axially on the side of the housing. The rotational motion of the switch levers therefore works solely against a constant, low frictional force that is independent of the number of poles and is caused by the axial seating. A seating of this type prevents the transmission of frictional forces onto adjacent switch levers. Because of this, the coupling rod permits a uniform transmission of the rotational motion of the directly triggering switch lever onto the other switch levers, even with a large number of poles. Notably, no time delay occurs when adjacent switch levers are triggered. The common triggering of all of the poles of the circuit breaker is therefore assured, further improving the operational reliability of the switch lever.

An additional effect of the switch lever coupling in accordance with the invention is that slight, production-related inaccuracies during production of the switch lever shells do not impede the transmission of rotational movements. As a result, the amount of waste in shell production is significantly reduced. This again decreases overall production costs of the switch lever. The switch lever bearings can be manufactured at low cost, contributing to economical shell production.

The switch lever coupling is simple to produce with respect to assembly, and therefore likewise has a cost-reducing effect on switch lever production. The coupling is realized in a single work step simply by pushing the coupling rod through the intermediate housing shells and the switch levers in the horizontal assembly direction directly before the closure shell is attached.

With this coupling, it is only necessary to keep on hand coupling rods whose length corresponds to the multiple of the width of a single pole chamber that extends in the horizontal assembly direction. This is possible to achieve without problems with regard to production technology. The coupling rod can be manufactured as a piece ware and simply cut into lengths.

Typically, the switch levers act as closed bearings for the coupling rod. This supports uniform transmission of force onto all of the switch levers. The small clearance between the coupling rod and its bearing assures limited room for movement of the coupling rod. The clearance also takes into account production-related dimensional tolerances in the alignment of all of the switch levers in the horizontal assembly direction of the circuit breaker. This also keeps the amount of waste small during production of the circuit breaker components. Furthermore, the clearance additionally simplifies the assembly of the coupling rod.

The thoroughgoing recess for the coupling rod is simple to manufacture. When a coupling bore serves as a bearing for the coupling rod, the coupling rod itself can also be manufactured simply—with respect to production technology—as a cylindrical rod. However, other cross-section shapes of coupling rods having corresponding thoroughgoing recesses are also conceivable in principle.

A plurality of switch levers may be disposed in a single pole chamber and penetrated by a coupling rod. Because of their identical lengths in the horizontal assembly direction, the different coupling rods can be cut into the proper length in a single work step. The manufacture of the coupling rods is further simplified when the coupling rods associated with the different switch levers in the same pole chamber are configured identically. This also simplifies coupling rod storage.

Typically, the coupling rod is adapted with respect to its length to the number of poles and the pole chamber width of the circuit breaker in such a manner that the rod is tangent to the housing shell and the closure shell with a small spacing at the end of assembly of the circuit breaker. This secures the coupling rod against unintended displacement movements in the horizontal assembly direction. All of the switch levers therefore remain reliably coupled with one another at the end of assembly of the circuit breaker.

Preferably, the coupling rod is tangential to a recess correspondingly formed out of the intermediate housing shell. Because of this, the switching movements of the circuit breaker are additionally guided. Erroneous movements of the circuit breaker are impossible. The rod recess encompasses the movement track of the coupling rod with little clearance, so that production-related variations of the displacement track are also taken into consideration.

The circuit breaker is simple to assemble. Because of their structural embodiment, the shells of the circuit breaker have numerous functions. For example, they act as defining walls for the pole chambers, as fastening means for the switching mechanism and as a housing shaft for a switching element that charges the switching mechanism. Because these varied functions are realized with a small number of one-piece components, the entire circuit breaker mechanism is less likely to be interference-prone.

The one-piece production of the different functional regions of the shells additionally assures great mechanical stability of the circuit breaker configuration.

In the production of the switching element, the cross-section of the housing shaft for receiving the switching element should be a function of the number of poles. The housing shaft can therefore also act as a guide element for guiding the switching movements of the switching element. A switching element adapted to the cross-section of the housing shaft acts as a reliable guard against damage and an electrical safeguard for all of the pole chambers of the circuit breaker. Furthermore, a switching element of this type permits easy manual operation, even of circuit breakers that have a larger number of poles.

Typically, the switching element assists the coupling rod. One working end of the switching element is associated with each switching mechanism. Therefore, when the circuit breaker is triggered manually, the switch levers are charged directly by the working end of the switching element, and not first by way of the deviation of a single switch lever and the coupling rod. The switching element is seated in simple fashion with respect to assembly.

In principle, it is possible to realize the pivotable seating of the switching element solely by means of the housing shell and the closure shell. However, if at least one intermediate housing shell is provided, the switching element can additionally be seated on this intermediate housing shell in an appropriate structural configuration, so that the mechanical stability of the pivotable seating of the switching element is assured and even further improved, even with a large number of poles. In this respect it is also conceivable that the switching element is seated to pivot on only a few of the total intermediate housing shells provided.

A cam rod, such as is shown in German Patent Application DE 2,721,162 A1, can be used with the circuit breaker. This coupling is disposed on the circuit breaker of the invention, between the switching element and the switching mechanism. Consequently, the switching element and the switching mechanism are coupled with one another by way of a cam rod extending in the horizontal assembly direction.

Typically, the switch levers are all identical and coupled to the cam rod by means of the coupling rod, in accordance with the invention. As a result, the switching element charges all of the switching mechanisms of the circuit breaker in a reliable manner and with a small expenditure of force.

A cover frame that can be mounted to the shells in a simple manner is provided as a mechanical damage protection element for the switching element. The cover frame has the additional function of fastening the shells together in the assembled state of the circuit breaker. By means of the simple attachment of the cover frame to the housing shaft, this fastening is simple with respect to assembly and requires no additional labor expenditure. Moreover, separate fastening means are omitted, which saves components.

An additional fastening means may further be provided to improve the mechanically stable configuration of the circuit breaker housing. Because the fastening means passes through all of the shells of the circuit breaker housing, it can also aid in assembly for the loose assembly of all of the shells.

Typically, the fastening means is simple to produce and assemble. Because the fastening means is disposed in the region of the housing bottom, and the cover frame secures the shells in the region of the housing shaft, the circuit breaker housing comprising a plurality of shells acts as a compact unit when assembled. By releasing the cover frame, the circuit breaker can be easily disassembled, if necessary, in the manner of a construction kit.

A parallel rod arrangement takes into consideration the fact that the rods are simple to assemble and require little space inside the pole chambers.

If at least one intermediate housing shell is used, it is possible to configure the necessary coupling rods identically to the cam rod. This additionally simplifies circuit breaker production and moreover facilitates storage of all of the rods.

The configuration of the compact circuit breaker is such that all the levers and rods pivot in the same plane of movement, which permits a very effective transmission of force among the components inside the pole chambers.

The subject of the invention is described in detail by way of examples shown in the drawings.

DETAILED DESCRIPTION OF THE INVENTION

Figure 1:
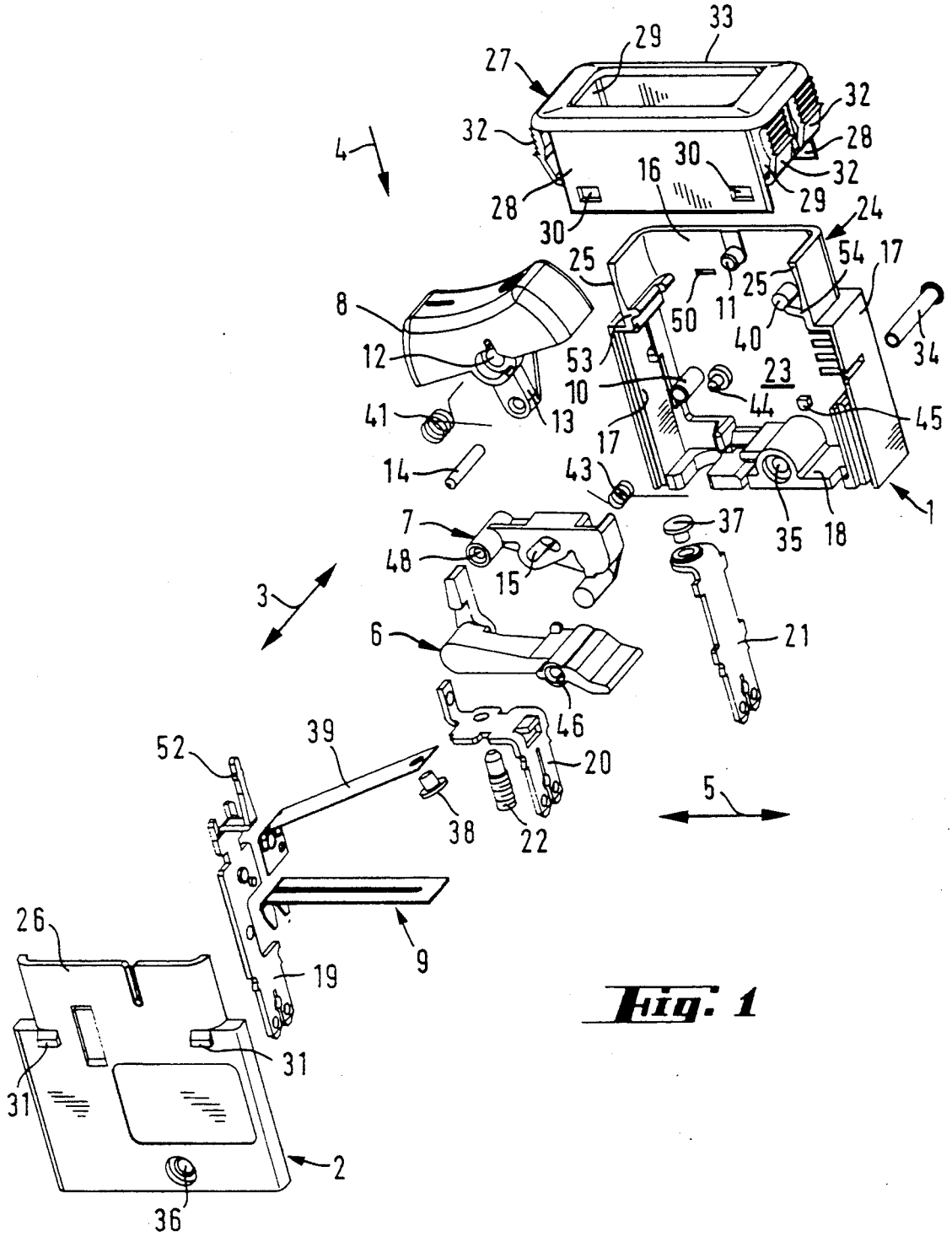
FIG. 1 is an exploded view of a single-pole circuit breaker with its switching mechanism.

The housing of the single-pole circuit breaker shown in FIG. 1 essentially comprises a housing shell 1 and a closure shell 2 oriented parallel thereto. The two shells 1 and 2 are displaced toward one another in an horizontal assembly direction 3, and are secured directly to one another at the end of assembly by their surfaces that face one another. The horizontal assembly direction 3 extends at a right angle to the shell plane in which the two shells 1 and 2 are located. The shell plane is defined by a vertical assembly direction 4 and a transverse direction 5. All directions 3, 4 and 5 extend at right angles to one another.

The plane defined by vertical assembly direction 4 and transverse direction 5 corresponds to the movement plane of the switching mechanism of the circuit breaker. The switching mechanism essentially comprises a trip lever 6, a latching lever 7 and a rocker switch 8 for manually turning the circuit breaker on and off. A bimetallic strip 9 extending in transverse direction 5 charges the trip lever 6 when overcurrent occurs, and because of this, brings about the trip-free release of the circuit breaker.

Trip lever 6 is disposed to pivot on a cylindrical axle arm 10 that extends in horizontal assembly direction 3. Rocker switch 8 is disposed to pivot on an axle arm 11. The two axle arms 10 and 11 are integral to the inner side of the housing shell 1 and are disposed parallel to one another. However, axle arm 10 extends further in the direction of the closure shell 2.

To provide pivotable seating, rocker switch 8, together with an axial bore 12 that penetrates the rocker switch in the horizontal assembly direction 3, encloses axle arm 11 when assembled. The corresponding bore of the trip lever used for the pivot seating of the lever on axle arm 10 is not visible in FIG. 1.

A working end 13 having a one-piece contour that tapers approximately conically in the direction of switch lever 7 is integral to rocker switch 8 in the region of axial bore 12. The conical tip of working end 13 facing latching lever 7 is rounded off in the manner of segments of a circle. There, working end 13 has a bore that extends in horizontal assembly direction 3 and is penetrated by a cylindrical cam rod 14 when assembled. At the end of assembly, cam rod 14 likewise penetrates an approximately V-shaped cam race 15 of switch lever 7. During the switching movement of rocker switch 8, cam rod 14 runs along cam race 15.

The structural embodiment and mode of operation of the switching mechanism are described in detail in DE 2,721,162 A1.

The two axle arms 10 and 11 are integral in one piece to the inner side of a housing wall 16 that forms a component of housing shell 1. Housing wall 16 lies in the plane defined by vertical assembly direction 4 and transverse direction 5. The edges of housing wall 16 that extend in vertical assembly direction 4 are each connected in one piece to a side housing wall 17. Side housing walls 17 are disposed at a right angle with respect to housing wall 16. Seen in vertical assembly direction 4, a U-shape of housing shell 1 results from this arrangement. Seen in horizontal assembly direction 3, a U-shaped contour of housing shell 1 likewise results. Side housing walls 17 act as two U-legs that extend in vertical assembly direction 4 and are connected to each other in one piece by a housing bottom 18. Housing bottom 18 lies in a plane defined by horizontal assembly direction 3 and transverse direction 5. The bottom has three notches extending in horizontal assembly direction 3 for non-positive reception of three parallel, plate-like contact connectors 19, 20 and 21, which protrude outwardly from housing bottom 18 at the end of assembly. The principle, structural embodiment and function of contact connectors 19, 20 and 21 is explained in DE 2,721,162 A1.

A further recess of the housing bottom serves to receive a cylindrical pin that extends with its longitudinal axis in vertical assembly direction 4, and acts as an adjusting screw 22 to adjust bimetallic strip 9.

On the side of housing shell 1, housing wall 16, side housing walls 17 and housing bottom 18 define a hollow chamber 23 of the circuit breaker housing that acts as a pole chamber. Seen from horizontal assembly direction 3, hollow chamber 23 is sealed on the side by closure shell 2 at the end of circuit breaker assembly. The edge regions of closure shell 2 lying in the shell plane, which extend in vertical assembly direction 4, are bent off in horizontal assembly direction 3, and rest directly against the edges of side housing walls 17, which face them.

At the end of assembly, hollow chamber 23 is accessible through a housing opening disposed opposite housing bottom 18 and counter to vertical assembly direction 4. This housing opening is defined by a rectangular housing shaft 24. Housing shaft 24 comprises free ends 25 of side housing walls 17, the partial region of housing wall 16 that connects the two free ends 25, and a free end acting as a component of closure shell 2. Free end 26, which is approximately rectangular and extends in horizontal assembly direction 3, is tapered in stepped fashion opposite the other region of closure shell 2. The extension of free end 26 in transverse direction 5 corresponds to the spacing in transverse direction 5 between the two free ends 25. Correspondingly, the two free ends 25 are staggered in transverse direction 5 with respect to the other region of side housing walls 17, so that housing shaft 24 has a smaller cross-section than the region of the circuit breaker housing that faces housing bottom 18.

At the end of assembly, housing shaft 24 encloses the partial region of rocker switch 8 that faces latching lever 7. Housing shaft 24 is enclosed in turn by a cover frame 27 at the end of assembly. Seen in vertical assembly direction 4, cover frame 27 has the contour of a rectangular frame. Cover frame 27 is configured with mirror symmetry with respect to an imaginary axis of symmetry that extends in the horizontal assembly direction and bisects the extension of cover frame 27 in transverse direction 5. The same applies to an axis of symmetry that extends in transverse direction 5 and bisects the extension of cover frame 27 in horizontal assembly direction 3. A plate-like frame wall 28 and 29, respectively, is integral in one piece to each frame side of cover frame 27. The two parallel frame walls 28 lying in planes defined by vertical assembly direction 4 and transverse direction 5 are integral to the longitudinal sides of cover frame 27. A rectangular holding recess 30 is disposed in each of the two corner regions of frame walls 28 facing housing bottom 18. At the end of assembly, each holding recess 30 cooperates with a corresponding latch 31 integral in one piece to the outer surface of free end 26 or the outer surface of housing wall 16, respectively. Only latches 31 integral to free end 26 are visible in FIG. 1.

The two frame walls 29 disposed on the broad sides of cover frame 27 and parallel to one another extend along vertical assembly direction 4 approximately as far as free end 25 of housing shaft 24. During assembly of the circuit breaker, cover frame 27 is attached to housing shaft 24 by displacing cover frame 27 in vertical assembly direction 4, until the frame walls 28 and 29 rest directly against the outer surfaces of housing shaft 24. The shoulder between side housing wall 17 and free end 25 serves as a limiting stop for the displacement movement of cover frame 27. At the end of assembly, the edge of cover frame 27 that faces housing bottom 18 and extends in horizontal assembly direction 3 rests against this shoulder. At the end of assembly, holding recesses 30 are penetrated by latches 31, and cover frame 27 is latched to housing shell 1 and closure shell 2. Frame walls 28 and 29 of cover frame 27, which are connected to one another in one piece, enclose housing shaft 24 and, in doing so, hold the multiple-part circuit breaker housing together in a mechanically stable manner.

Two latch (spring) arms 32 disposed next to each other in horizontal assembly direction 3 are integral to the outer surface of each frame wall 29. Seen in horizontal assembly direction 3, latch (spring) arms 32 on frame walls 29 are bent, and extend counter to vertical assembly direction 4. On cover frame 27's outer surface facing away from frame wall 29, each spring arm 32 has in the region of its free end a grooved surface with grooves that extend in horizontal assembly direction 3. These grooves simplify manual operation of spring arms 32. Furthermore, spring arms 32 latch in, for example, control panels when the circuit breaker is installed, permitting secure seating of the circuit breaker.

Spring arms 32 further permit simple handling of cover frame 27 so that it can be latched to or released from the circuit breaker housing. Frame walls 28 and 29 are defined counter to vertical assembly direction 4 by means of a covering collar 33 that is integral to the frame walls in one piece. Covering collar 33 lies in a plane defined by horizontal assembly direction 3 and transverse direction 5 and forms the cover surface of cover frame 27. Covering collar 33 likewise has the shape of a rectangular frame, and protrudes with its corresponding frame sides on both sides of frame walls 28 in horizontal assembly direction 3, and on both sides of frame walls 29 in transverse direction 5. The frame walls of covering collar 33 that extend in horizontal assembly direction 3 cover the free ends of spring arms 32.

At the end of assembly, the two shells 1 and 2 are riveted together in the region of housing bottom 18 by means of a tubular rivet that extends in horizontal assembly direction 3. For this purpose a cylindrical elevated portion having a longitudinal axis that extends in horizontal assembly direction 3 is integral to the surface of housing bottom 18 facing the hollow chamber 23. The elevated portion is penetrated completely by a cylindrical bore 35. Closure shell 2 is penetrated by a rivet bore 36. Cylindrical bore 35 and rivet bore 36 are aligned at the end of assembly of the two shells 1 and 2. At the end of assembly, tubular rivet 34 penetrates cylindrical bore 35 and rivet bore 36, and in the process holds the two shells 1 and 2 together in a mechanically stable manner in the region of housing bottom 18.

Figure 2:
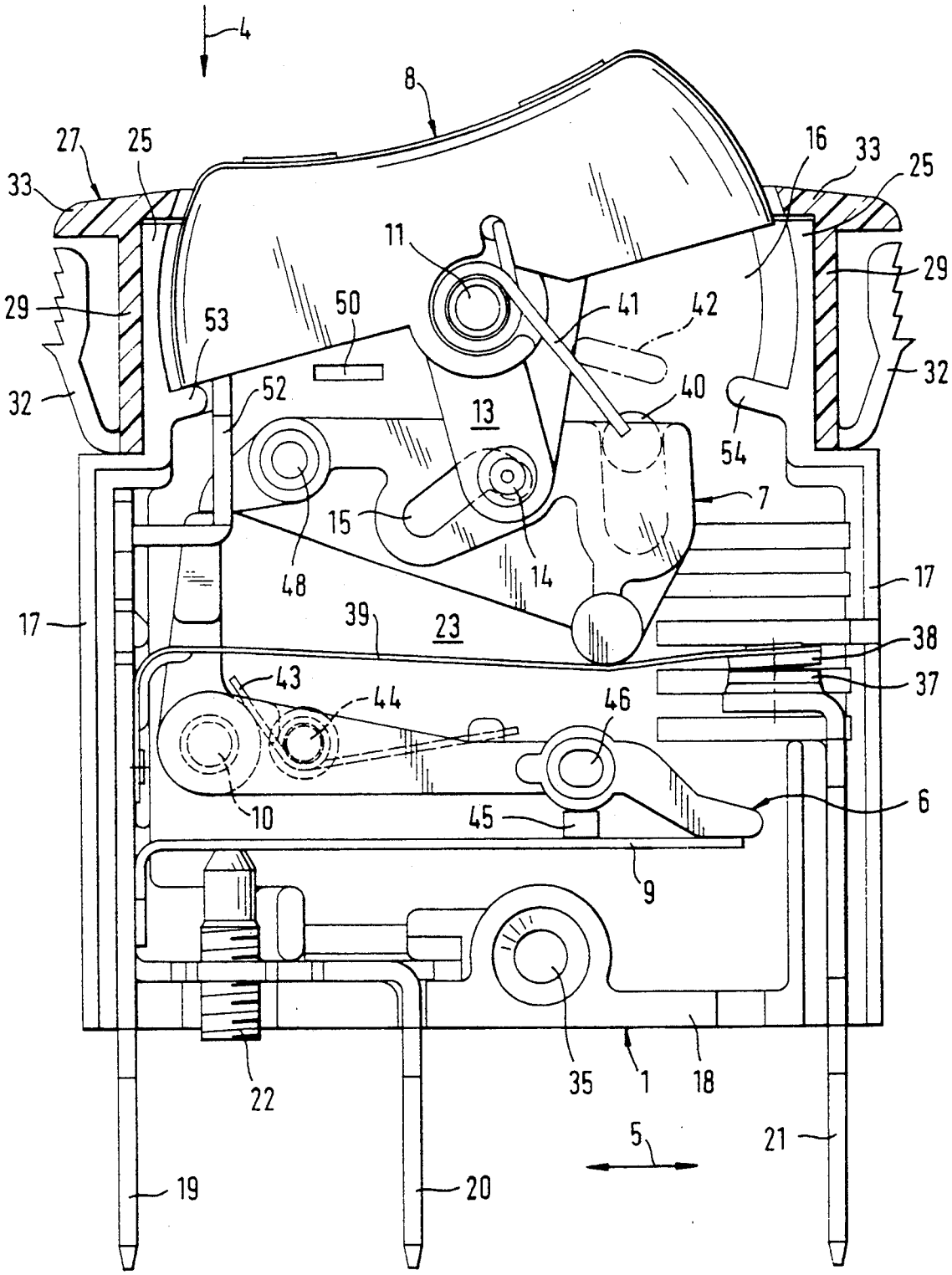
FIG. 2 is a side view of the opened single-pole circuit breaker with the switching mechanism inserted.

In FIG. 2 the circuit breaker is in its on-position. To achieve this, a fixed contact 37 and a mobile contact 38 are mechanically and electrically contacted, as is known from DE 2,721,162 A1. Fixed contact 37 and mobile contact 38 are each recognizable in FIG. 1 as circular plates. Fixed contact 37 is secured to the free end of contact connector 21, which end extends in transverse direction 5. Mobile contact 38 is secured to the free end of a contact spring 39 acting as a leaf spring. Contact spring 39 extends essentially in transverse direction 5 and is secured to contact connector 19.

In a known way, a cylindrical guide pin 40 whose longitudinal axis extends in horizontal assembly direction 3 is integral to housing wall 16 to guide the pivoting movement of latching lever 7.

In addition to rocker switch 8, a torsion spring 41 is seated on axle arm 11. The longer of the two legs of torsion spring 41 is supported against a spring stop 42. The spring stop has a contour of an oblong slot, and is integral with the closure shell 2 (not shown in FIG. 2). Torsion spring 41 supports the switching movements of rocker switch 8.

An additional torsion spring 43 supports the pivoting movements of trip lever 6. Torsion spring 43 is seated on a fastening pin 44, which extends parallel to axle arm 11 and is likewise integral to housing wall 16. The longer of the two legs of torsion spring 43 is supported against the lever arm of trip lever 6 extending in transverse direction 5. The shorter spring leg is supported against trip lever 6 in the region of axle arm 10.

So that the lever position of trip lever 6 is unambiguous, a lever stop 45 that has a rectangular contour is integral to housing wall 16 between bimetallic strip 9 and the lever arm of trip lever 6 that extends in transverse direction 5. A cylindrical partial region of trip lever 6 whose cylindrical axis extends in horizontal assembly direction 3 rests against lever stop 45. This partial region of trip lever 6 is penetrated by a coupling bore 46 that extends in horizontal assembly direction 3 and has the shape of an oblong bore. At the end of assembly, coupling bore 46 is penetrated by a coupling rod 47, which will be described in FIG. 3.

Analogously to trip lever 6, latching lever 7 is penetrated in a cylindrical partial region by a coupling bore 48. Coupling bore 48 is located in a free end, by means of which latching lever 7 charges trip lever 6. Coupling bore 48 is circular. It is penetrated by a coupling rod 49 (FIG. 1) at the end of assembly of the circuit breaker.

Figure 4:
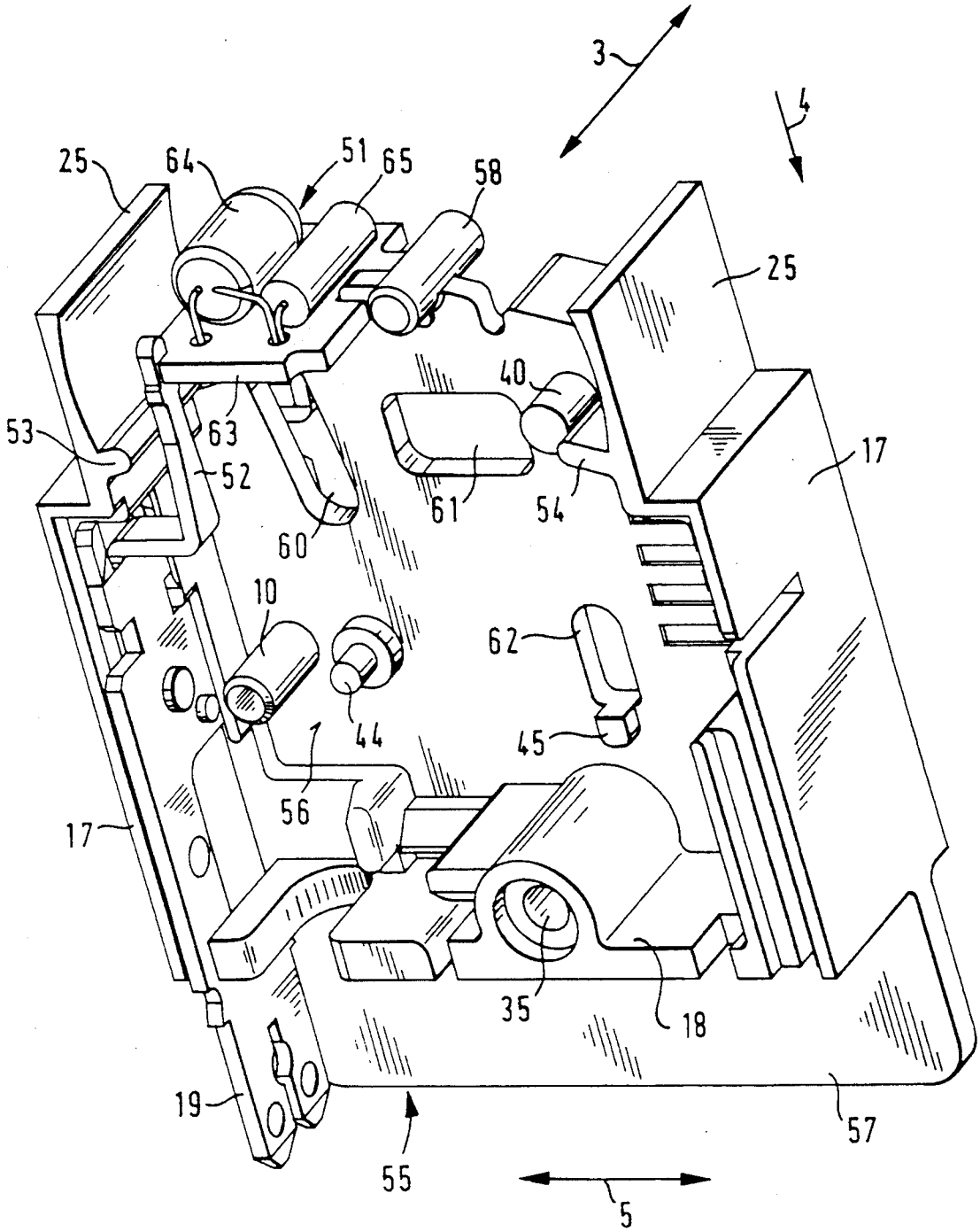
FIG. 4 is an enlarged representation of the intermediate housing shell of FIG. 3 with lighting components.

A rectangular housing slit 50 whose longitudinal side extends in transverse direction 5 can be seen between rocker switch 8 and trip lever 6 in FIG. 2. The slit serves as the entrance for an electrical contact path for a lighting components 51 (FIG. 4). A second contact path is formed by a column-like contact extension that extends in vertical assembly direction 4 (FIG. 4). The extension is a one-piece component of contact connector 19. Lighting components 51 serves in the visual display of the switch position of rocker switch 8.

The inner sides of free ends 25 are arched in concave fashion facing rocker switch 8, and are disposed along the entire vertical assembly direction 4 with parallel spacing to the outer surface of rocker switch 8 that faces the vertical assembly direction and is likewise arched. With its outer surface, which faces the arched side of rocker switch 8 and extends at an incline with respect to vertical assembly direction 4, covering collar 33 forms an extension of the concave-type arch of the inner side of free end 25.

A peg-like rocker stop 53 that points in the direction of axle arm 11 is integral to free end 25 facing contact extension 52, opposite covering collar 33, in vertical assembly direction 4. At approximately the same assembly height, a further rocker stop 54 is integral to the free end 25 located opposite in transverse direction 5. This stop is likewise oriented toward axle arm 11, and is approximately twice as long as rocker stop 53. The two rocker stops 53 and 54 serve to limit the switching movements of rocker switch 8.

Figure 3:
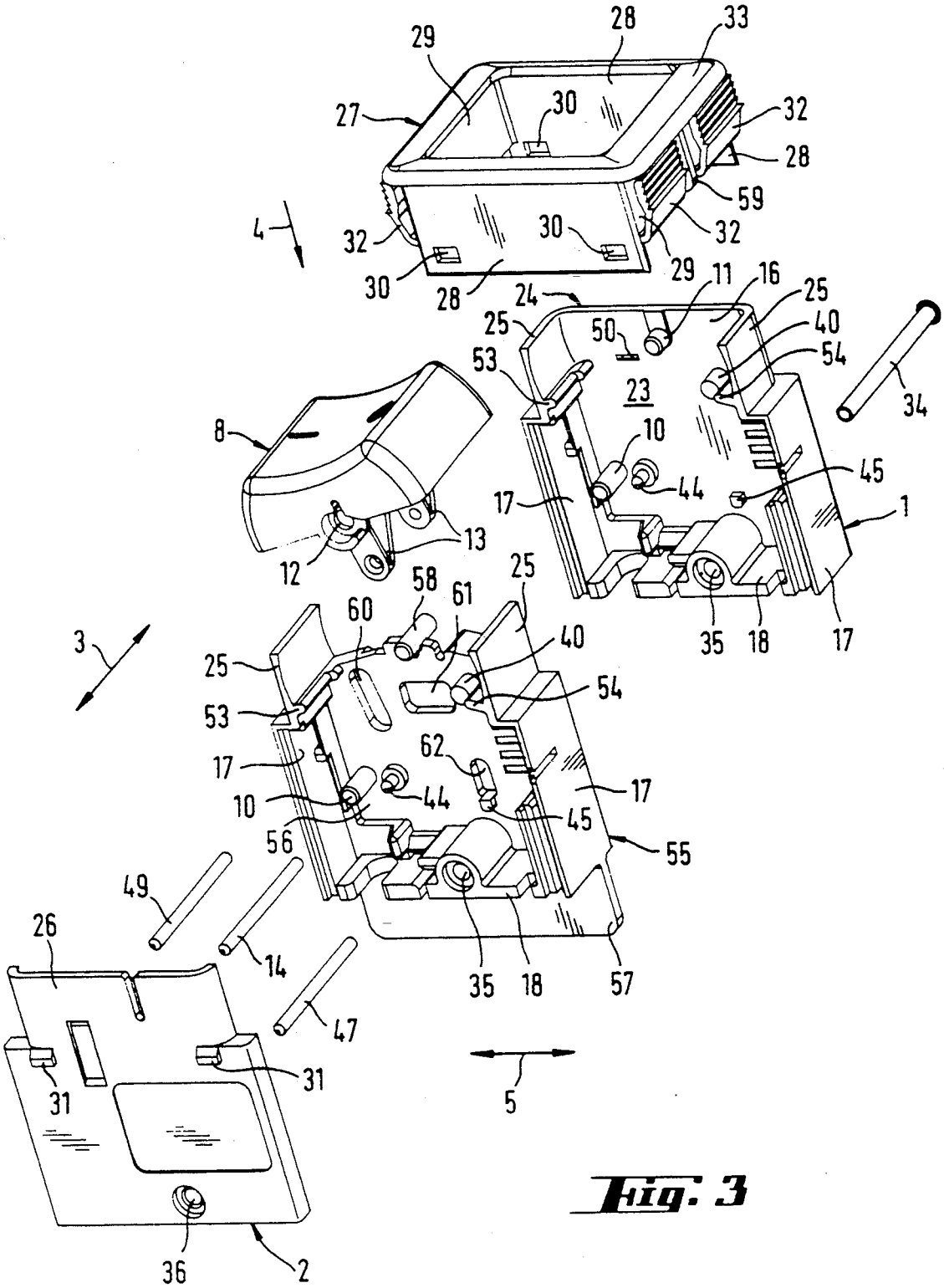
FIG. 3 is an exploded view of a dual-pole circuit breaker showing the coupling parts.

The single-pole circuit breaker seen in FIG. 1 is expanded to a dual-pole circuit breaker in FIG. 3 by inserting an intermediate housing shell 55 between housing shell 1 and closure shell 2. Intermediate housing shell 55 is subdivided along horizontal assembly direction 3 by an intermediate wall 56 into two partial regions, namely a partial region acting as closure shell 2 and a partial region acting as housing shell 1. The partial region of intermediate housing shell 55 acting as housing shell 1 and facing closure shell 2 can be seen in FIG. 3. The intermediate housing shell is embodied identically to housing shell 1 with respect to its structural features that are crucial for seating an identical switching mechanism.

In contrast to housing shell 1, an extension plate 57 is integral in one piece to the outer side of housing bottom 18 of intermediate housing wall 55. The plate lies in a plane defined by vertical assembly direction 4 and transverse direction 5. Seen in horizontal assembly direction 3, it has an approximately rectangular contour. In transverse direction 5 the extension of the plate corresponds to the spacing between the two side housing walls 17 of intermediate housing shell 55. Extension plate 57 acts as an extension of intermediate wall 56 in vertical assembly direction 4. Extension plate 57 can serve, for example, to secure intermediate housing shell 55 during assembly of the circuit breaker housing, so that the individual shells 1, 2 and 55 can simply be assembled in sequence. Extension plate 57 can also serve in securing and providing comfortable handling of the circuit breaker housing at the end of assembly.

The region of intermediate housing shell 55 located opposite housing bottom 18 along vertical assembly direction 4 and facing rocker switch 8′ is structurally modified with respect to the corresponding region of housing shell 1. Whereas side housing walls 17 of intermediate housing shell 55 and housing shell 1 are aligned in horizontal assembly direction 3 when assembled, intermediate wall 56 opposite housing wall 16 has a lower assembly height along vertical assembly direction 4. In the region of side housing walls 17, intermediate wall 56 is approximately flush with rocker stops 53 and 54. Seen in horizontal assembly direction 3, intermediate wall 56 has a somewhat tapered extension starting from the two rocker stops 53 and 54 and extending in the direction of an axle arm 58 for pivotable seating of rocker switch 8′. The cylindrical axle arm 58, whose longitudinal axis extends in horizontal assembly direction 3, is aligned with axle arm 11 at the end of assembly. Axle arm 58 protrudes on both sides beyond intermediate wall 56 in horizontal assembly direction 3. The approximately conical extension of intermediate wall 56, with shoulder-shaped recesses, takes into consideration the pivotability of rocker switch 8′.

Free ends 25 of intermediate housing shell 55 extend with free ends 25 of housing shell 1 in horizontal assembly direction 3, thereby enlarging the cross-section of housing shaft 24. Rocker switch 8 of FIG. 1 is replaced in FIG. 3 by an embodiment 8′ that is expanded to correspond to the circuit breaker which is expanded by one pole. Corresponding to the two provided switching mechanisms, two working ends that are aligned when seen in horizontal assembly direction 3 are also integral to rocker switch 8′. Furthermore, cover frame 27 of FIG. 1 is replaced by a cover frame 27′ whose frame walls 29′ are correspondingly lengthened in horizontal assembly direction 3. Spring arms 32′ of the cover frame 27′ of FIG. 3 are also extended in horizontal assembly direction 3. As can clearly be seen in FIG. 3, the two spring arms 32′ are separated from one another by a covering wall 59 that is integral to frame wall 29′ and extends parallel to frame walls 28.

Tubular rivet 34 of FIG. 1 is likewise exchanged in FIG. 3 for a corresponding tubular rivet 34′ that is lengthened in horizontal assembly direction 3. Cam rod 14 of FIG. 1 for mechanically coupling rocker switch 8 with latching lever 7 is exchanged in FIG. 3 for a version 14′ lengthened in horizontal assembly direction 3. Cam rod 14′ of FIG. 3 penetrates cam races 15 of latching lever 7 of the two poles, so that approximately simultaneous pivoting occurs of the two latching levers 7, each having identical movement paths. Cam rod 14′ and the two coupling rods 47′ and 49′ are disposed parallel to horizontal assembly direction 3 at the end of assembly. The rods have approximately the same length and are embodied as cylindrical rods that have approximately the same diameter. Moreover, latching levers 7 of the two switching mechanisms, which are not shown in FIG. 3, are mechanically connected to one another by means of coupling rod 49′. The two trip levers 6 are mechanically connected to one another by means of coupling rod 47′. In this way, when coupled, the two trip levers 6 are moved uniformly using a single bimetallic strip 9. So that cam rod 14' and the two coupling rods 47' and 49' can also be pivoted in the plane of movement of trip lever 6 and latching lever 7 to correspond to their pivoting movements, intermediate wall 56 is broken through by shaft recesses 60, 61 and 62. The profile of shaft recesses 60, 61 and 62 is the slightly enlarged likeness of the movement path of cam rod 14' and coupling rods 47' and 49' with the viewing direction being horizontal assembly direction 3. Shaft recess 60 is associated with coupling rod 49' and has a cross-section of an oblong hole. The longitudinal sides of the oblong shaft recess 60 extend at an acute angle to vertical assembly direction 4 and are inclined in the direction of rocker stop 53.

Along vertical assembly direction 4, shaft recess 61 is approximately at the same height as shaft recess 60. The recess has a rectangular cross-section and corners rounded off in quarter-circles. Shaft recess 61 is associated with cam rod 14' and is disposed between shaft recess 60 and guide pin 40.

Lighting components 51 can clearly be seen in FIG. 4. It essentially comprises a printed circuit board 63, a glow lamp 64 and a resistor 65. An incandescent lamp or an LED can be used in place of glow lamp 64. With a multipole circuit breaker, lighting components 51 are placed on the contact extensions 52 of two adjacent intermediate housing shells 55 and soldered in place. The current paths on printed circuit board 63 are guided such that the desired electrical connections are realized. If the circuit breaker has a single pole, printed circuit board 63 is mounted with a connection on contact extension 52 of contact connector 19. The second electrical connection is then brought to printed circuit board 63 by way of housing slit 50.

Figure 5:
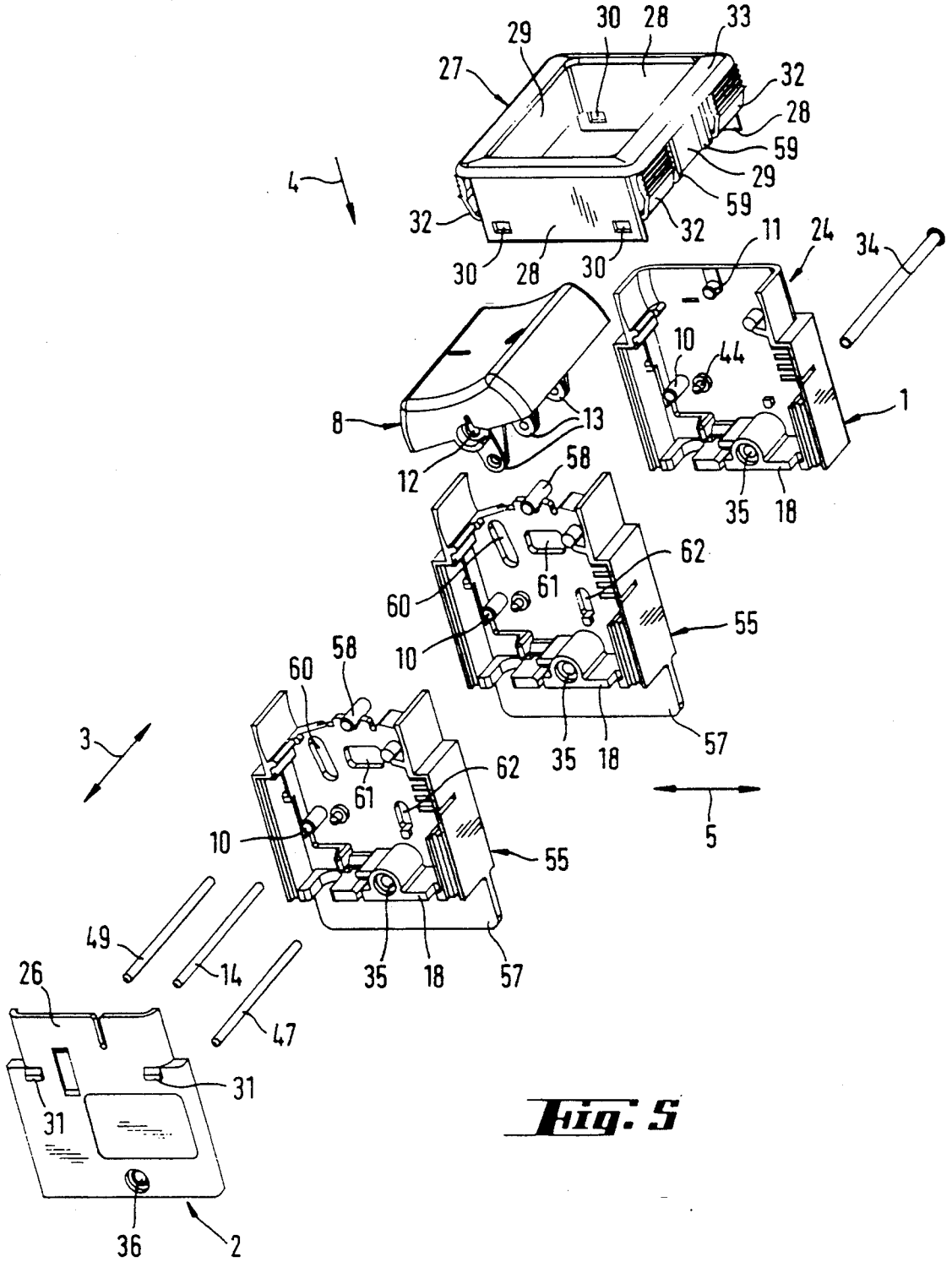
FIG. 5 is an exploded view of a triple-pole circuit breaker showing the coupling parts.

In FIG. 5, a total of two intermediate housing shells is inserted between housing shell 1 and closure shell 2. The result of this is a triple-pole circuit breaker that has three identical switching mechanisms, not shown here. Correspondingly, a total of three working ends are integral to rocker switch 8''. To adapt the dual-pole circuit breaker shown in FIG. 3 to the one seen in FIG. 5, merely the tubular rivet 34', cam rod 14', coupling rods 47' and 49', rocker switch 8' and cover frame 27' need each be exchanged for an embodiment that is extended in horizontal assembly direction 3.

Also in FIG. 5, a covering wall 59' is associated with each spring arm 32''. This also improves the mechanical stability of frame wall 29''.

The multipole circuit breaker is assembled in the following manner. First, a number of intermediate housing shells 55 that correspond to the desired number of poles of the circuit breaker are assembled in horizontal assembly direction 3. The following applies: for n poles, n−1 intermediate housing shells 55 are required. The switching mechanism is already seated on each intermediate housing shell 55. During assembly of intermediate housing shells 55, rocker switch 8' or 8'' must also be seated to pivot by means of axle arm 58. Once the required number of intermediate housing shells 55 has been assembled, housing shell 1 is attached with its switching mechanism, which is likewise already seated, to the closest intermediate housing shell 55. During this, care must be taken to ensure that axle arm 11 extends into axial bore 12 of the rocker switch. Afterward cam rod 14' or 14'' is inserted through all cam races 15, through the bores of working ends 13 and through shaft recesses 61. Coupling rods 47' or 47'' are inserted in the same way through all coupling bores 46 and all of the shaft recesses 62 in horizontal assembly direction 3. Analogously, coupling rod 49' or 49'' passes through all coupling bores 48 and all shaft recesses 60 at the end of assembly. Afterward closure shell 2 is attached to the closest intermediate housing shell 55. The circuit breaker housing is thus closed on all sides in horizontal assembly direction 3 and transverse direction 5. Following this cover frame 27' or 27'' is slipped onto housing shaft 24 in vertical assembly direction 4. At the end of assembly, the cover frame is latched with closure shell 2, and in this way keeps all of shells 1, 2 and 55 together in a mechanically stable manner in the region of housing shaft 24. Tubular rivet 34' or 34'' is pushed through cylindrical bores 35, which are aligned, and rivet bore 36 in horizontal assembly direction 3. By means of the tubular rivet, shells 1, 2 and 55 are also connected to one another in a mechanically stabile manner in the region of housing bottom 18.

Additional functional elements, such as no-volt release switches, magnetic tripping devices or signal circuits can also be connected to contact connectors 19, 20 and 21.

It will be understood that the above description of the present invention is susceptible to various modifications, changes and adaptations, and the same are intended to be comprehended within the meaning and range of equivalents of the appended claims.

What is claimed is:

1. A multi-pole circuit breaker comprising:

a housing including a housing shell and a closure shell attached thereto to form a hollow chamber therebetween, said closure shell and said housing shell each having an inside wall surface extending parallel to a shell plane;

n−1, where n is an integer greater than 1, intermediate housing shells inserted between said housing shell and said closure shell and having first and second wall surfaces corresponding to said housing shell wall surface and said closure shell wall surface, respectively, said first wall surface facing said closure shell wall surface and said second wall surface facing said housing shell wall surface to form n hollow pole chambers;

a switching mechanism for tripping the circuit breaker, said switching mechanism including a switch lever located within each said pole chamber comprising at least one of a trip lever and a latching lever, each said switch lever being attached to a respective wall surface and being axially seated to pivot in a plane of movement extending approximately parallel to the shell plane; and at least one one-piece coupling rod penetrating each said switch lever and each said intermediate housing shell in a direction perpendicular to the shell plane for coupling each said switch lever together for common triggering of all poles.

2. A multi-pole circuit breaker as defined in claim 1, wherein said coupling rod penetrates each said switch lever with clearance.

3. A multi-pole circuit breaker as defined in claim 2, wherein each said switch lever has a coupling bore for accommodating said one-piece coupling rod.

4. A multi-pole circuit breaker as defined in claim 1, wherein each said coupling rod has an identical length.

5. A multi-pole circuit breaker as defined in claim 1, wherein each said pole chamber has a width extending in a direction perpendicular to the shell plane, and wherein said coupling rod has a length approximately corresponding to the width of said n pole chambers.

6. A multi-pole circuit breaker as defined in claim 1, said intermediate housing shell further comprising an intermediate wall being parallel to the shell plane, said intermediate wall separating said first and second wall surfaces and having an opening therethrough for accommodating said coupling rod, said opening having a contour corresponding to an enlarged movement path of said coupling rod.

7. A multi-pole circuit breaker as defined in claim 1, wherein said housing shell and said intermediate housing shell have essentially U-shaped cross-sections in the shell plane for encapsulating said switching mechanism, and wherein each housing shell and intermediate housing shell includes a bottom comprised of the base of the U-shaped cross sections, and two sides comprised of the legs of the U-shaped cross sections and being perpendicular to said base, each said side having a free end disposed distally to said base to form a housing shaft being an opening into said housing; said switching mechanism further comprising a switching element accommodated within the interior of said housing shaft and cooperating with said switch lever for manually triggering the circuit breaker.

8. A multi-pole circuit breaker as defined in claim 7, wherein said intermediate housing shell further comprises an intermediate wall being parallel to the shell plane and having perimeter edges, said intermediate housing wall being perpendicular to and integral at said parameter edges with said intermediate housing shell base and side walls.

9. A multi-pole circuit breaker as defined in claim 7, wherein said switching element is seated on a respective wall surface, said switching element being movable to engage with said switch lever.

10. A multi-pole circuit breaker as defined in claim 9, wherein said switching element is pivotally seated.

11. A multi-pole circuit breaker as defined in claim 10, wherein said housing shell inside wall surface has a perpendicular axle arm for the pivotal seating of said switching element.

12. A multi-pole circuit breaker as defined in claim 10, wherein said switching element is pivotally seated on at least one intermediate housing shell.

13. A multi-pole circuit breaker as defined in claim 12, wherein said at least one intermediate housing shell has an axle arm perpendicular to the shell plane for the pivotal seating of said switching element.

14. A multi-pole circuit breaker as defined in claim 7, wherein each said pole chamber and said switching element has a width extending in a direction perpendicular to the shell plane, said switching element width approximately corresponding to the width of said n pole chambers.

15. A multi-pole circuit breaker as defined in claim 7, wherein said switching element has a width extending in a direction perpendicular to said shell plane, and n working ends disposed along the width for cooperating with n switch levers.

16. A multi-pole circuit breaker as defined in claim 7, wherein said switching element comprises a rocker switch forming a two-armed lever.

17. A multi-pole circuit breaker as defined in claim 7, wherein said switching element has a working end being movably connected to said latching lever to form a toggle lever drive having a toggle joint for opening and closing a switch contact; and further comprising a one-piece cam rod penetrating said working end and each said latching lever in a direction perpendicular to the shell plane to form said toggle joint, said one-piece cam rod being guided by said working end and said latching levers.

18. A multi-pole circuit breaker as defined in claim 17, wherein each said latching lever comprises an enclosed cam race, each said latching lever being penetrated by said cam rod at said cam race for common guidance of said cam rod.

19. A multi-pole circuit breaker as defined in claim 17, wherein each said one-piece coupling rod and said cam rod are essentially parallel to each other.

20. A multi-pole circuit breaker as defined in claim 17, wherein each said one-piece coupling rod and said cam rod are essentially identical.

21. A multi-pole circuit breaker as defined in claim 17, wherein each said one-piece coupling rod, said cam rod and said switching mechanism all pivot in parallel planes.

22. A multi-pole circuit breaker as defined in claim 7, and further comprising a lid-type frame having a receiving opening for accommodating said switching element, said frame being attached to said housing shaft whereby said frame surrounds said switching element.

23. A multi-pole circuit breaker as defined in claim 22, wherein said frame frictionally engages and surrounds said housing shaft.

24. A multi-pole circuit breaker as defined in claim 22, wherein said frame latches to said housing.

25. A multi-pole circuit breaker as defined in claim 1, wherein each said pole chamber has a width extending in a direction perpendicular to the shell plane, and wherein said housing shell, each intermediate housing shell, and said closure shell, respectively, are penetrated by a fastening means for attaching the shells together, said fastening means having a length approximately corresponding to the width of said n pole chambers.

26. A multi-pole circuit breaker as defined in claim 25, wherein said housing shell, each intermediate housing shell, and said closure shell each have a base region having a bore, each said bore being essentially perpendicular to the shell plane and being in axial alignment with each other, and wherein said fastening means is a tubular rivet penetrating each said bore.

27. A multi-pole circuit breaker as defined in claim 1, wherein a one-piece coupling rod penetrates each said trip lever and another one-piece coupling rod penetrates each said latching lever.

28. A circuit breaker comprising:

a housing including a housing shell and a closure shell attached thereto to form a hollow pole chamber therebetween, said closure shell and said housing shell each having an inside wall surface extending parallel to a shell plane;

a switching mechanism for tripping the circuit breaker, said switching mechanism including at least one switch lever located within said pole chamber comprising at least one of a trip lever and a latching lever, each said switch lever being attached to a respective wall surface and being axially seated to pivot in a plane of movement extending approximately parallel to the shell plane; and at least one one-piece coupling rod penetrating each said switch lever in a direction perpendicular to the shell plane for coupling each said switch lever together for common triggering of all poles.

29. A multi-pole circuit breaker as defined in claim 28, wherein each said coupling rod has an identical length.

* * * * *